United States Patent [19]

Coombs et al.

[11] Patent Number: 4,905,899

[45] Date of Patent: Mar. 6, 1990

[54] ATOMISATION OF METALS

[75] Inventors: Jeffrey S. Coombs; Gordon R. Dunstan, both of West Glamorgan, Wales

[73] Assignee: Osprey Metals Limited, Wales

[21] Appl. No.: 263,448

[22] Filed: Oct. 24, 1988

Related U.S. Application Data

[63] Continuation-in-part of Ser. No. 929,526, Nov. 12, 1986, Pat. No. 4,779,802.

[30] Foreign Application Priority Data

Oct. 22, 1988 [GB] United Kingdom ..... 8824823

[51] Int. Cl.[4] ..... B05B 1/28

[52] U.S. Cl. ..... 239/11; 239/292; 239/300; 164/46; 264/12

[58] Field of Search ..... 239/290, 292, 293, 295, 239/296, 300, 301, 225.1, 226, 102.1, 264, 227, 265.23, 11; 164/46; 264/12

[56] References Cited

U.S. PATENT DOCUMENTS

| | | | |
|---|---|---|---|
| 2,738,231 | 3/1956 | Kurtz | 239/293 |
| 3,077,306 | 2/1963 | Herzog | 239/236 |
| 3,970,249 | 8/1976 | Singer | 239/102.1 |
| 4,064,295 | 12/1977 | Singer | 427/424 |

FOREIGN PATENT DOCUMENTS

| | | | |
|---|---|---|---|
| 0127303 | 12/1984 | European Pat. Off. . | |
| 808310 | 7/1951 | Fed. Rep. of Germany . | |
| 1625245 | 6/1970 | Fed. Rep. of Germany . | |
| 2043882 | 3/1971 | Fed. Rep. of Germany . | |
| 1389541 | 1/1965 | France | 239/290 |
| 621457 | 8/1978 | U.S.S.R. | 264/12 |
| 1262471 | 2/1972 | United Kingdom . | |
| 1379261 | 1/1975 | United Kingdom . | |
| 1472939 | 5/1977 | United Kingdom . | |
| 2146662 | 4/1985 | United Kingdom . | |

*Primary Examiner*—Robert J. Oberleitner
*Assistant Examiner*—Karen B. Merritt
*Attorney, Agent, or Firm*—Roylance, Abrams, Berdo & Goodman

[57] ABSTRACT

A device for gas atomising a liquid stream, such as a stream of molten metal or metal alloy, has an atomising device including, for example, an annular opening for receiving the stream. The atomising device is arranged for applying atomising gas to the stream so as to form a spray of atomised particles. At least a part of the atomising gas, and preferably all, is applied by means movable relative to the stream whereby movement is imparted to the spray to achieve improved uniformity or control of deposition by moving the spray either by moving the atomising device with a symmetric gas flow field relative to the stream or by oscillating or rotating a rotor mounted within the atomising device and arranged to produce an asymmetric gas flow field.

23 Claims, 6 Drawing Sheets

FIG. 3a.
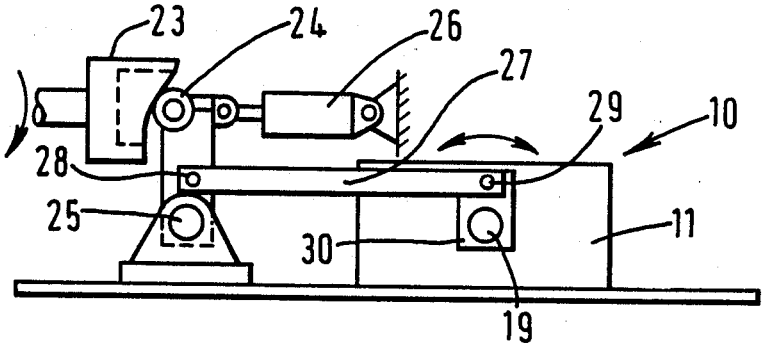
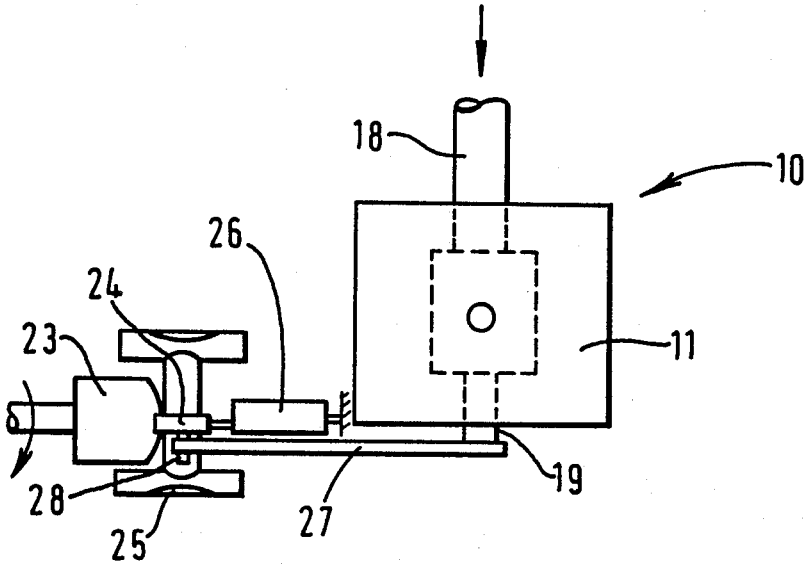
FIG. 3b.

ATOMISATION OF METALS

RELATED APPLICATION

This application is a continuation-in-part of U.S. patent application Ser. No. 929526 filed 12 Nov. 1986, now U.S. Pat. No. 4,779,802.

FIELD OF THE INVENTION

This invention relates to a device for gas atomising a liquid stream, such as a stream of molten metal or metal alloy.

BACKGROUND OF THE INVENTION

The atomising and spray depositing of a stream of liquid metal has been known for many years, for example from British Patent Specification No: 1262471, and our own British Patent Specification Nos: 1379261 and 1472939. However, it has always been a problem to achieve precise control of the mass deposition in the metal on the deposition surface.

One proposal to improve the control of the mass distribution of the deposited layer of gas atomised of metal is set out in British Patent Specification No: 1455862 where it is proposed to oscillate the spray of atomised particles by the use of a primary set of gas jets for atomisation and two sets of secondary jets which are rapidly switched on and off to impart an oscillatory motion to the spray of atomised metal.

However, it was found that the arrangement did not give ideal control of the mass distribution of the metal deposited. Therefore, an alternative proposal for imparting a direction to a spray was suggested as disclosed in European Patent Publication No: 0127303A. That arrangement involves the switching on and off of individual gas jets which accomplish the function of both atomising and oscillating the spray. However, both these methods are very difficult to control, and in particular lack flexibility in operation.

In the first proposal the use of secondary jets can result in excess cooling of the deposited metal meaning that subsequently arriving particles do not coalesce properly with the already deposited metal. In the second method the shape and properties (eg temperature) of the spray can change as individual jets are switched on and off which makes it extremely difficult to ensure uniform deposition and solidification conditions.

SUMMARY OF THE INVENTION

An object of the present invention is to provide an improved device for gas atomizing a liquid stream, such as a stream of molten metal or metal alloy and for imparting controlled and precise movements to the atomised liquid stream.

According to the present invention there is provided apparatus for gas atomising a liquid stream, such as a stream of molten metal or metal alloy, and for controlling the mass distribution of a layer deposited from the atomised stream, the combination comprising:

an atomising device;

a plenum chamber forming a part of the atomising device and defining an opening through which the stream may be teemed;

atomising means communicating with the plenum chamber for forming an atomising gas flow field of predetermined geometry which atomises the stream into a spray of droplets; and means for moving the atomising gas flow field relative to the stream whereby the application of said movement may impart movement to the spray whilst the geometry of the atomising gas flow field remains substantially constant.

The invention also includes a method of moving a spray comprising the steps of passing a liquid stream, such as a stream of molten metal or metal alloy, through an atomising device, atomising the stream by the application of an atomisation gas forming an atomising gas flow field relative to the stream during atomisation to impart movement to the spray whilst maintaining the geometry of the atomising gas flow substantially constant.

The improved method of the present invention does not involve the switching on and off of gas jets to oscillate the spray. Instead, despite the proximity to the nozzle from which molten metal issues, we have devised a system whereby the spray is moved by moving the atomising jets themselves or the whole atomising device. This has the following particular advantages over previous method:

(a) on average the atomising conditions can be kept relatively constant because gas jets are not being switched on and off, i.e. the atomising gas flow field can be kept substantially constant so that the atomising conditions may be the same or otherwise controlled regardless of the degree of movement of the spray;

(b) the movement imparted is preferably an oscillation and the angle of oscillation can be changed very easily merely by increasing the angle of tilt of the whole or part of the atomiser during each cycle; or, in an alternative arrangement, by varying movements of atomising rotors;

(c) the rate of oscillation can be easily varied; and (d) the speed of oscillation at any instant during each cycle of oscillation can be easily varied.

Consequently, the apparatus and method of the present invention provides a very high degree of control over the atomising device and the movement of the spray which previously has not been attainable. This enables the oscillation conditions to be varied to suit the shape of deposit being produced or to control the deposition conditions and/or the profile of the spray on the surface of the collector.

In one form of the method of the invention the liquid stream is molten metal or metal alloy, the spray is directed at a substrate moving continuously through the spray and the spray is moved transverse to the direction of movement to achieve uniformity of thickness of depostion across the width of the substrate whereby strip, coated strip, plate or coated plate products may be formed.

BRIEF DESCRIPTION OF THE DRAWINGS

The invention will now be described by way of example with reference to the accompanying drawings in which:

FIG. 3*a* is a plan and FIG. 3*b* is a side elevation of the preferred atomiser of the first embodiment of the invention;

DESCRIPTION OF THE PREFERRED EMBODIMENTS

Figure 1:
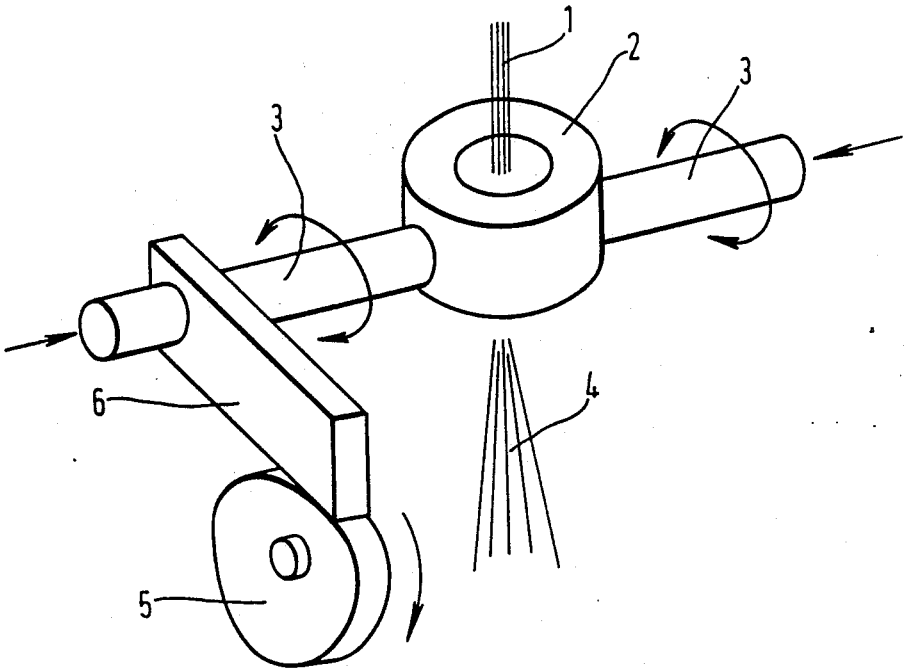
FIG. 1 is a perspective diagrammatic view of a first embodiment of apparatus in accordance with the invention.

In FIG. 1 of the drawings a liquid stream 1, such as molten metal or metal alloy, is teemed through an atomising device 2. The device 2 is generally annular in shape and is supported by diametrically projecting supports 3. The supports 3 also serve to supply atomising gas to the atomising device in order to atomise the stream 1 into a spray 4. In order to impart movement to the spray 4 the projecting supports 3 are mounted in bearings (not shown in FIG. 1) so that the whole atomising device 2 is able to tilt about the axis defined by the projecting supports 3. The control of the tilting of the atomising device 2 comprises an eccentric cam 5 and a cam follower 6 connected to one of the supports 3 as will be explained. By altering the speed of rotation of the cam 5 the rate of oscillation of the atomising device 2 can be varied. In addition, by changing the surface profile of the cam 5, the speed of oscillation at any instant during the cycle of oscillation can be varied. The oscillation typically can be up to 30° from the stream axis although the movement may not necessarily be centered on the stream axis, this will depend upon the shape of the deposit being forged.

Figure 2A:
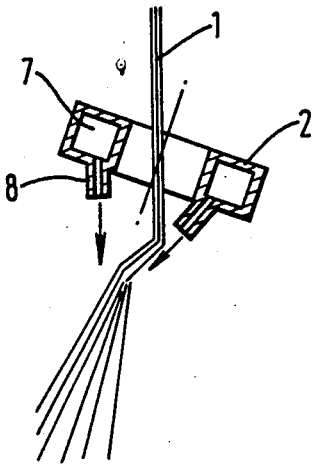
FIGS. 2*a*, 2*b* and 2*c* illustrate diagrammatically the mode of movement of the atomising device of FIG. 1 and hence the movement imparted to a spray.
Figure 2B:
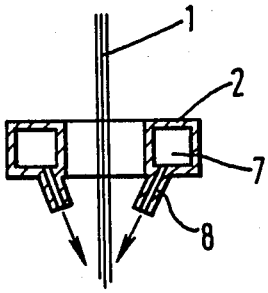
Figure 2C:
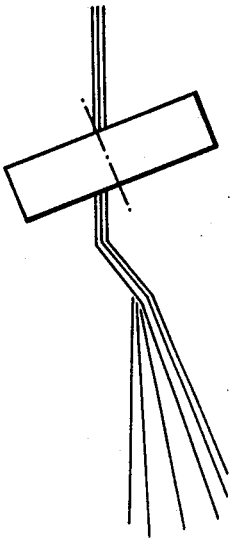

From FIGS. 2*a*, 2*b* and 2*c* it can be seen that the atomising device 2 comprises a plenum chamber 7 and a plurality of gas atomising means consisting of nozzles 8. In the preferred embodiment the whole atomising device 2 is tiltable as indicated by FIGS. 2*a*, 2*b* and 2*c* so that, as it is tilted the gas issuing from the nozzles 8 imparts lateral movement to the spray.

Figure 4:
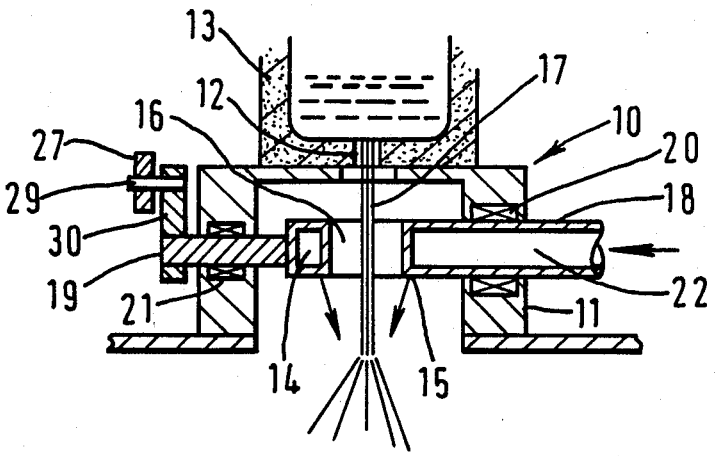
FIG. 4 is sectional side elevation of the atomiser of the first embodiment of the invention.

FIGS. 3*a*, 3*b* and 4 illustrate a preferred embodiment of the invention in more detail. In those Figures an atomising device 10 is positioned within an atomiser housing 11 and below the nozzle opening 12 of tundish 13. The atomising device 10 includes a plenum chamber 14 and has atomising gas jet openings 15. The atomising device 10 is substantially annular in shape having a central opening 16 through which a stream 17 from the tundish 13 is arranged to pass. The atomising device is supported within the housing 11 by diametrically opposed supports 18, 19 which project outwardly from the atomising device 10 and is positioned sufficiently away from the bottom of the tundish 13 and has a central opening 16 dimensioned so that the atomising device may be made to undergo a tilting motion. So that this tilting motion may be achieved the supports 18, 19 are mounted within respective bearings 20, 21 in the atomiser housing 11. One of the supports 18, also serves as a conduit 22 to supply atomising gas to the plenum chamber 14.

The movement of the atomising device 10 is effected by mechanical means consisting of a drum cam 23 rotated by drive means (not shown) and, a cam follower 24 pivoted at 25 and held against the cam profile by means of a pneumatic cylinder 26. The cam follower 24 has a connecting arm 27 pivoted to it at 28 and the arm 27 extends to a further pivotal connection 29 on a plate 30. The plate 30 is freely movable and is fixed to the support 19, as clearly shown in FIG. 4, at a position offset from the pivotal connection 29.

Accordingly, it will be understood that movement of the drum cam 23 is translated into movement of the atomising device 10 via the cam follower 24, connecting arm 27 and plate 30. The cam profile may be designed to define a predetermined degree of movement and the speed of rotation of the drum cam, which may be readily controlled in a known manner by an electric motor, the speed of movement of the atomising device. Movement of the atomising device, suitably a to and fro oscillatory movement, imparts a corresponding movement to the spray since the atomising device 10 carries with it the atomising gas jet openings 15.

Figure 5:
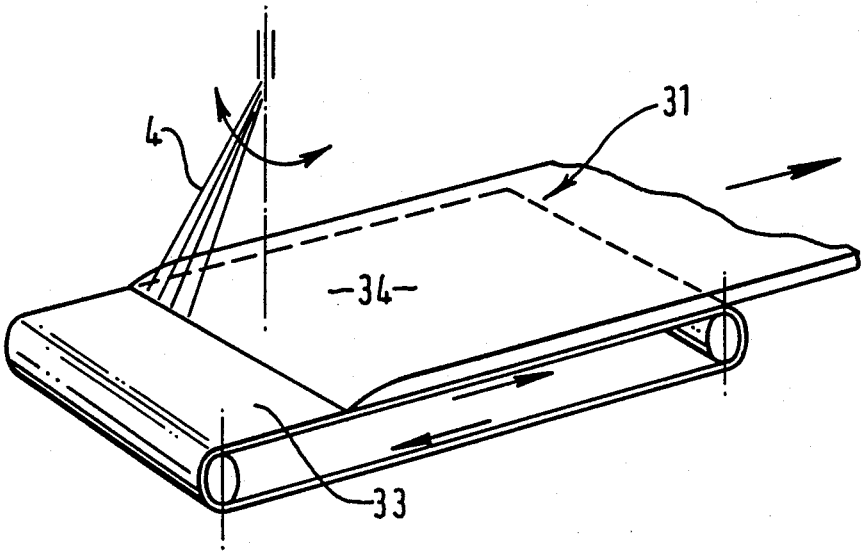
FIG. 5 is a diagrammatic perspective view of the use of the first embodiment of the invention as applied to the manufacture of strip.
Figure 6:
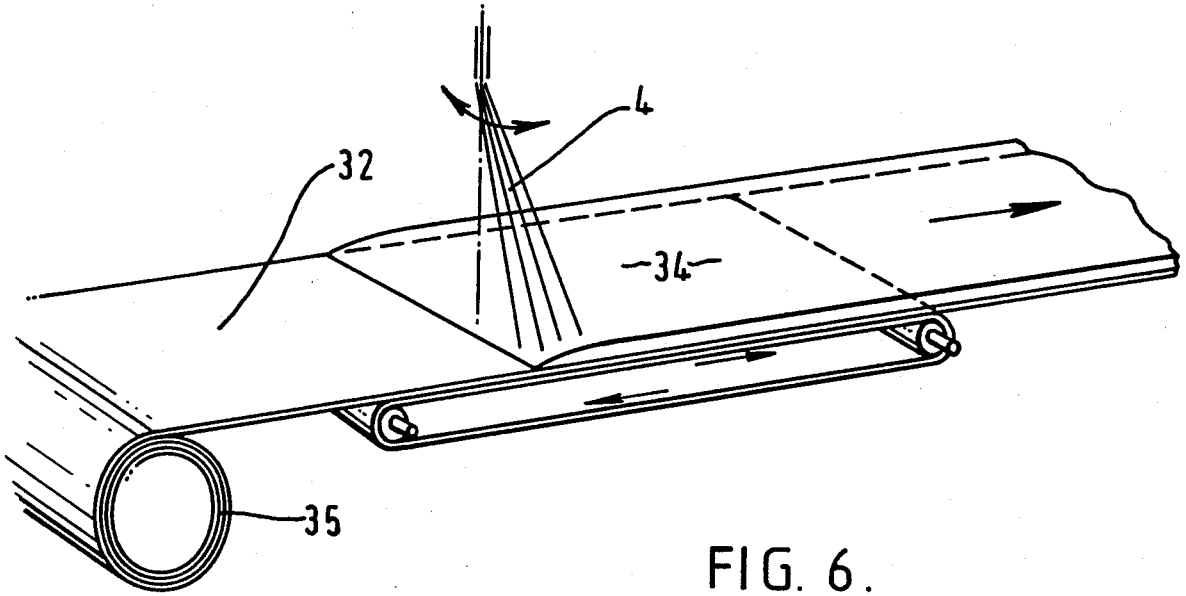
FIG. 6 is a diagrammatic perspective view of the use of the first embodiment of the invention as applied to the coating of strip.

The atomising device of the present invention is particularly useful for producing strip or plate 31 as illustrated in FIG. 5. Also, the apparatus may be used for producing spray coated strip or plate products 32 as shown in FIG. 6. In producing these products the spray is moved to and fro at right angles to the direction of movement of a collector 33 moving continuously through the spray as indicated by the arrows in the Figures. This ensures that the deposit 34 is formed uniformly across the width of the collector, or substrate, preferably in the thickness range 0.5 mm–50 mm. Preferably the substrate or collector will pass a plurality of atomising devices aligned along the axis of the movement of the substrate. In respect of coated strip or plate 31 the substrate to be coated may suitably be unwound from a decoiler 35 diagrammatically illustrated in FIG. 6. Although the present invention is particularly suitable for forming strip, plate and coated strip and plate it will be understood, that the atomiser can be used beneficially for producing many other products including ingots, bars, tubes, rings, rolls, conical shapes forging and extrusion blanks, spray coated products, laminates, composites, and products for thixotropic deformation etc. The substrate or collector may be a flat substrate, an endless belt or a rotatable mandrel.

The formation of strip will now be described by way of example:

| EXAMPLE OF STRIP PRODUCTION: WIDTH = 300 mm | |
|---|---|
| DEPOSITED MATERIAL | 0.15% CARBON STEEL |
| POURING TEMP. | 1580 degrees centigrade |
| METAL POURING NOZZLE | 9.0 mm bore |
| SPRAY HEIGHT | 630 mm (i.e. Distance from the underside of the atomiser to collector) |
| OSCILLATING SPEED | 10 cycles/sec |
| OSCILLATING ANGLE | ±13° about a vertical axis |
| ATOMISING GAS | Nitrogen |
| COLLECTOR | 0.5 mm thick × 300 mm wide × 1000 m length mild steel plate - grit blasted. |
| COLLECTOR MOVEMENT | 40 mm/sec |
| LIQUID METAL FLOW RATE INTO ATOMISER | 58 kg/min |
| GAS/METAL RATIO | 0.3 Kg/Kg |
| DEPOSITED THICKNESS | 8 mm |
| EXAMPLE OF STRIP PRODUCTION: WIDTH | 155 MM |

-continued

| EXAMPLE OF STRIP PRODUCTION: WIDTH = 300 mm | |
|---|---|
| DEPOSITED METAL | 0.15% CARBON STEEL |
| POURING TEMP. | 570° Centigrade |
| METAL POURING NOZZLE | 9.0 mm bore |
| SPRAY HEIGHT | 630 mm |
| OSCILLATING ANGLE | +/−7 degrees about a vertical axis |
| OSCILLATING SPEED | 10 cycles/sec |
| ATOMISING GAS | Nitrogen |
| COLLECTOR | 0.5 mm × 155 mm wide × 1000 mm length mild steel plate |
| COLLECTOR MOVEMENT | 60 mm/sec |
| LIQUID METAL FLOW RATE INTO ATOMISER | 60 kg/min |
| GAS/METAL RATIO | 0.35 Kg/Kg |
| DEPOSIT THICKNESS | 10 mm |

In the present invention the spray cone generated by the atomising device is always maintained and the gas jets which, in prior inventions, were used to impart an oscillation to the spray, are used merely for atomisation. Although in the first embodiment the atomising device has included a plurality of gas outlets as an alternative the atomising gas means may simply be a single gas opening such as an annulus.

In the first embodiment of the invention the atomising device is oscillated in order to achieve oscillation of the spray in a controlled manner.

Figure 7:
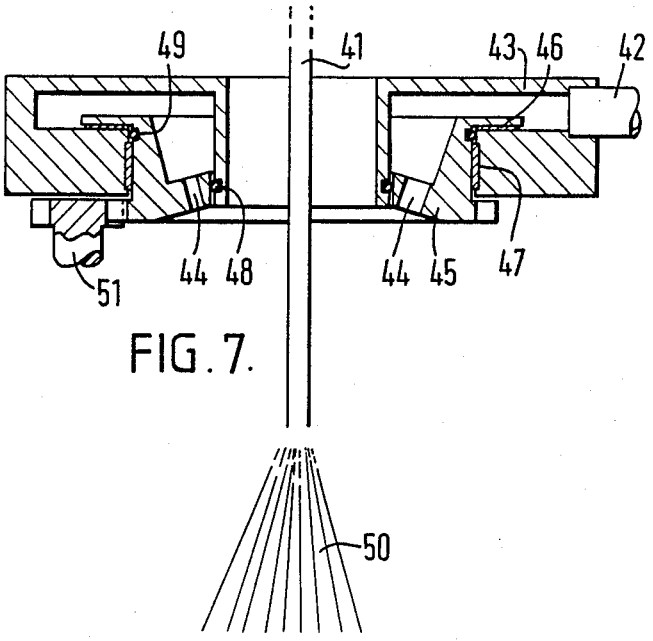
FIG. 7 is a cross-section of a second embodiment of atomising device in accordance with the invention.

However, by adapting the atomising device in other ways it is possible to achieve the same oscillating movement of the spray without actually oscillating the device itself. In FIG. 7, a liquid stream 41 of molten metal or metal alloy is atomised by gas which is fed via pipes 42 to an atomiser body 43. The gas exits through orifices 44 arranged around the liquid stream 41 in a rotor 45 which is movable about the axis of the liquid stream 41 and may be arranged either to oscillate to and fro or to undertake complete rotation about the stream. As can be seen from the figure the size of the orifices 44 differ according to the circumferential position around the liquid stream in order to generate an assymmetric atomising gas field. The rotor 45 is held in position by bearings 46 and 47, and gas leakage is prevented between the rotor 45 and the atomiser body 43 by suitable seals 48 and 49 as shown. The gas jets emerging from the orifices 44 atomise the liquid stream 41 to form the spray 50. The rotor 45 is movable about the stream 41 by means of a driven actuating means 51 such as a spur gear for example. On rotation or oscillation to and fro of the rotor the asymmetry of the atomising gas field imparts rotation or an oscillation to the spray 50.

Figure 8:
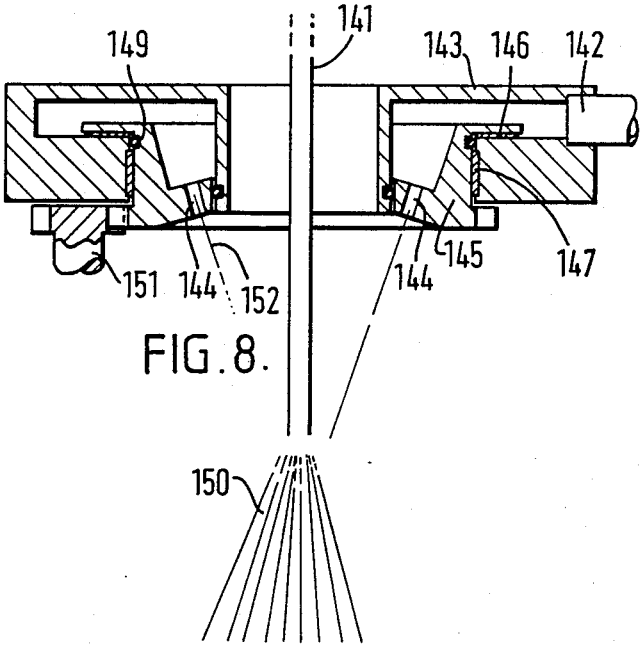
FIG. 8 is a cross-section of a third embodiment of atomising device in accordance with the invention.

In FIG. 8 a similar apparatus is shown including a rotor 145 and similar reference numerals have been used in a one hundred series to indicate corresponding parts. However, in FIG. 8, instead of varying the size of orifice 144 about the circumference of the atomising device the angles of attack of the emerging gas jets (indicated by references 152) are varied about the circumference to produce the asymmetric spray pattern. If desired, combinations of FIG. 7 and FIG. 8 are possible i.e. varying the orifice size and the angles of attack.

Figure 9:
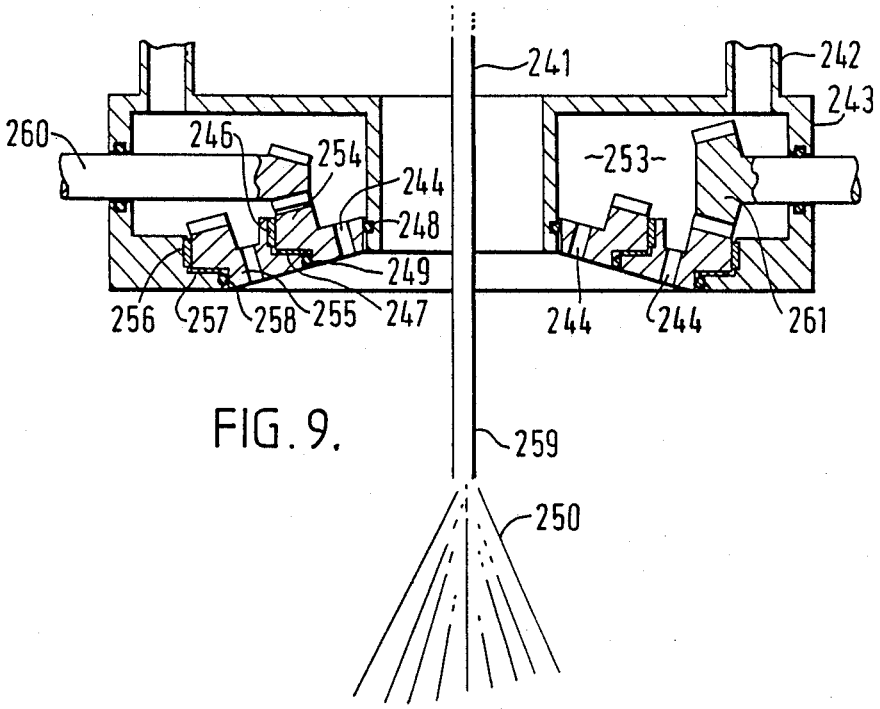
FIG. 9 is a cross-section of a fourth embodiment of atomising device in accordance with the invention.

In the embodiment of FIG. 9 an asymmetric atomising gas field is produced by means of two rotors which are rotatable relative to each other and to the atomiser body. In FIG. 9 a liquid metal stream 241 passing through the atomiser body is atomised by an atomising gas fed via feed pipes 242 to the atomiser body 243. The gas is received in a plenum chamber 253 and exits the atomiser body 243 through atomising orifices 244. The orifices 244 are arranged in two circular arrays in two concentric rotors 254, 255 and are distributed about the stream 241 in order to atomise it. The size of the orifices in each rotor 254, 255 differ according to their circumferential position around the liquid stream in order to generate an assymmetric atomising gas field. However, by using two rotors 254, 255, more flexibility in the control of the resultant spray shape is provided.

The inner rotor 254 is held in position by bearings 246 and 247 and the outer rotor 255 by bearings 256 and 257. Gas leakage is prevented between the rotors 254, 255 and the atomiser body 243 by suitable seals 248, 249 and 258. The atomising gas jets emerge from the orifices 244 and atomise the liquid steam 241 to form a spray 250. The arrays of gas jets in the respective rotors 254, 255 may be focussed at a single atomising point relative to the stream or at an atomising zone 259 where the stream 241 is broken up into a spray. The rotors 254, 255 are movable by means of respective bevel gears 260, 261. By synchronising the two rotors 254, 255 the asymmetric gas flow field can be kept substantially constant and rotation or to and fro oscillation imparts movement to the spray whilst it retains its same cross-sectional shape determined by the gas flow field. However, by moving one rotor relative to the other the gas flow field may be altered as well which provides increased flexibility.

Figure 10A:
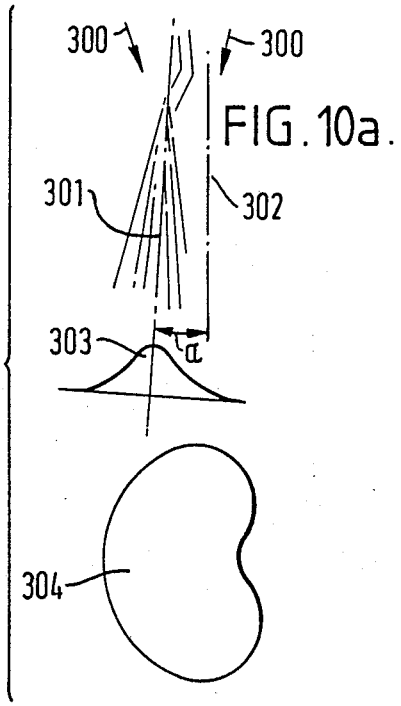
FIGS. 10*a* and 10*b* are examples of spray profiles that can be achieved with the present invention.

In use, referring to FIG. 10*a* if the pattern of the atomising gas jets emerging from respective orifices 44, 144, 244 (not shown) is arranged such that the result is a conical jet the axis 301 of which is inclined at a small angle $\alpha$ relative to the axis 302 of rotation of the respective rotors, then the spray profile 303 will be symmetric about the conical jet axis 301 even though the gas field is assymmetric with respect to the atomising device. If the rotor is oscillated too and fro then the effective spray profile can be modified as indicated by the plan view 304 at the bottom of FIG. 10*a*.

Figure 10B:
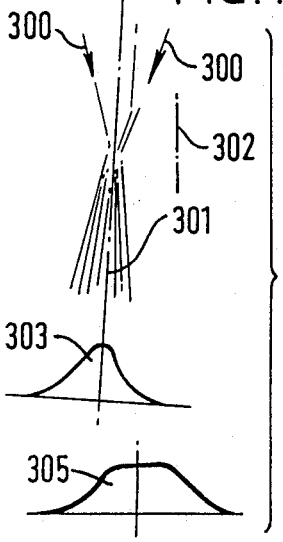

In FIG. 10*b* the rotor is rotated to form the effective spray profile 305. Obviously, the actual spray profiles produced are a function of the gas jet pattern and the velocity profile applied to the respective rotor which may be oscillation or rotation.

If desired the rotor movement may also be used in combination with an oscillation of the whole atomiser body as indicated in the embodiments of FIGS. 1 to 6.

Whilst the invention has been particularly described with reference to the atomisation of liquid metal streams, the invention may be applicable to the atomisation of other liquid streams such as liquid ceramics or liquid stream or spray into which solid metallic or non-metallic particles or fibres are injected or incorporated. Also, whilst the present invention has been described with reference to mechanical control means, preferred methods for controlling the movement of the atomiser and/or rotor(s) may be electro-mechanical means such as a program controlled stepper motor, or hydraulic means such as a program controlled electro-hydraulic servo mechanism using a linear actuator to control oscillation and/or rotational movement.

The above devices can also be used for producing gas atomised metal powders whereby the movement of the spray can impart improved cooling to the atomised particles.

We claim:

1. Apparatus for gas atomising a liquid stream, such as a stream of molten metal or metal alloy, and for controlling the mass distribution of a layer deposited from the atomised stream, the combination comprising:

an atomising device;

a plenum chamber forming a part of the atomising device and defining an opening through which the stream may be teemed;

atomising means communicating with the plenum chamber for forming an atomising gas flow field of predetermined geometry which atomises the stream into a spray of droplets; and means for moving the atomising gas flow field relative to the stream whereby the application of said movement may impart movement to the spray while the geometry of the atomising gas flow field remains substantially constant, the atomising device being annular and the atomising means comprising a plurality of atomising jets in a rotor, the rotor being movable relative to the atomising device.

2. Apparatus according to claim 1 wherein the atomising jets in the rotor produce a gas flow field which is asymmetric.

3. Apparatus according to claim 2 wherein the asymmetric gas flow field is produced by the atomising jets issuing from orifices in the rotor which vary in size about the rotor.

4. Apparatus according to claim 2 wherein the asymmetric gas flow field is produced by varying the angle of attack of the atomising jets about the rotor.

5. Apparatus according to claim 1 wherein the atomising device includes two rotors each including an array of atomising jets and each being movable relative to the other and to the atomising device.

6. Apparatus for gas atomising a liquid stream, such as a stream of molten metal or metal alloy, and for controlling the mass distribution of a layer deposited from the atomised stream, the combination comprising:

an atomising device;

a plenum chamber forming a part of the atomising device and defining an opening through which the stream may be teemed;

atomising means communicating with the plenum chamber for forming an atomising gas flow field of predetermined geometry which atomises the stream into a spray of droplets;

means for moving the atomising gas flow field relative to the stream whereby the application of said movement may impart movement to the spray while the geometry of the atomising gas flow field remains substantially constant; and control means for controlling the moving means so as to move the spray through a predetermined cycle of movements, the control means comprising a spur gear connecting with a rotor in the atomising device operative to move the rotor relative to the atomising device.

7. Apparatus for gas atomising a stream and for controlling the deposition conditions of a deposit formed from deposition of the atomised stream, the combination comprising:

an annular atomising device having a central opening through which the stream may pass;

a plenum chamber formed within the atomising device;

means coupled to the atomising device for supporting the atomising device including an inlet path communicating the plenum chamber with an atomising gas source;

a rotor mounted within the atomising device for movement relative to the atomising device;

a plurality of atomising gas jet openings formed in the rotor for directing atomising gas onto the stream passing through the opening, the atomising gas jet openings being positioned in a predetermined fixed relationship relatived to one another so as to form an asymmetric atomising gas flow field of predetermined geometry; and means for moving the rotor relative to the atomising device whereby the asymmetry of the atomising gas flow field imparts movement to the spray with the geometry of the atomising gas flow field remaining substantially constant and whereby the shape and deposition conditions of a formed deposit are controlled.

8. Apparatus according to claim 7 wherein the asymmetry of the gas flow field is produced by varying the size of the atomising gas jet openings about the rotor.

9. Apparatus according to claim 7 wherein the asymmetry of the gas flow field is produced by varying the angle of attack of the atomising gas emerging from the atomising gas jet openings about the rotor.

10. Apparatus according to claim 7 wherein the atomising device includes a second rotor mounted within the atomising device concentric to the first rotor and movable relative to the first rotor and/or the atomising device, the second rotor including a second plurality of atomising gas jet openings.

11. Apparatus according to claim 7 including control means operative to impart either oscillating to and fro movement to the rotor or rotation.

12. Apparatus according to claim 10 including means for moving the atomising device angularly about an axis passing through the support means.

13. Apparatus for controlling the mass distribution of a layer deposited on a surface by an atomised stream, the combination comprising:

a device for forming an asymmetric atomising gas flow field of predetermined geometry which atomises the stream into a spray of droplets comprising a plenum chamber defining an opening through which the stream is teemed and an atomising rotor mounted to communicate with the plenum chamber and including a plurality of jets for directing atomising gas with an asymmetric gas flow field toward the stream to break the stream up into a spray; and means for moving the rotor about said stream whereby the asymmetry of the gas flow field causes the spray to oscillate.

14. Apparatus for gas atomising a liquid stream, such as a stream of molten metal or metal alloy, and for controlling the mass distribution of a layer deposited from the atomised stream, the combination comprising:

an atomising device defining an opening through which the stream may be teemed;

atomising means for forming an atomising gas flow field of predetermined geometry which atomises the stream into a spray of droplets; and means for moving the atomising gas flow field relative to the stream whereby movement may be imparted to the spray whilst the geometry of the atomising gas flow field remains substantially constant.

15. A method of moving a spray comprising the steps of passing a liquid stream, such as a stream of molten metal or metal alloy, through an atomising device, atomising the stream by the application of an atomisation gas forming an atomising gas flow field of predetermined geometry which atomises the stream into a spray of droplets, and moving the atomising gas flow field relative to the stream during atomisation to impart movement to the spray whilst maintaining the geometry of the atomising gas flow field substantially constant.

16. A method according to claim 15 comprising moving the atomising device about an axis to impart an oscillation to the gas flow field.

17. A method according to claim 15 comprising arranging the gas flow field so as to be asymmetric and moving the gas flow field relative to the stream so as to impart movement to the spray.

18. A method according to claim 15 wherein the liquid stream is molten metal or metal alloy, the spray is directed at a substrate moving continuously through the spray and the spray is moved transverse to the direction of movement to achieve informity of thickness of deposition whereby strip, coated strip, plate or coated plate products may be formed.

19. A method according to claim 18 comprising moving the substrate continuously through sprays of a plurality of atomising devices aligned in the direction of movement of the substrate.

20. A method according to claim 18 wherein the substrate is a collector selected from a flat substrate, an endless belt or a rotatable mandrel.

21. A method according to claim 18 wherein metallic or ceramic particles are applied to the spray to be incorporated in the deposit formed on the substrate.

22. A method according to claim 17 wherein the movements of the spray are controlled to produce spray deposited ingots, bars, tubes, rings, roll, conical shapes, forging and extrusion blanks, shapes for thixotropic deformation, laminated or coated products and metal matrix composites.

23. A method according to claim 17 wherein the liquid stream is molten metal or metal alloy, the spray being allowed to cool and solidify in flight whereby metal powder is formed.

* * * * *